US011746997B2

(12) United States Patent
Wedekind

(10) Patent No.: US 11,746,997 B2
(45) Date of Patent: Sep. 5, 2023

(54) RECESSED LUMINAIRE HOUSING ASSEMBLY

(71) Applicant: SPECTRUM LIGHTING, INC., Fall River, MA (US)

(72) Inventor: Robert James Wedekind, Riverside, RI (US)

(73) Assignee: SPECTRUM LIGHTING, INC., Fall River, MA (US)

( * ) Notice: Subject to any disclaimer, the term of this patent is extended or adjusted under 35 U.S.C. 154(b) by 18 days.

(21) Appl. No.: 17/492,013

(22) Filed: Oct. 1, 2021

(65) Prior Publication Data

US 2023/0107356 A1 Apr. 6, 2023

(51) Int. Cl.
*F21V 21/04* (2006.01)

(52) U.S. Cl.
CPC ..... *F21V 21/049* (2013.01); *F21V 21/044* (2013.01)

(58) Field of Classification Search
CPC ..... F21V 21/04; F21V 21/049; F21V 21/044; F21S 8/026; F21S 8/028
USPC ..... 362/148, 150, 364, 365
See application file for complete search history.

(56) References Cited

U.S. PATENT DOCUMENTS

| | | | | |
|---|---|---|---|---|
| 2,989,206 | A | 6/1961 | McAfee | |
| 3,955,701 | A | 5/1976 | Fisch | |
| 5,042,673 | A | 8/1991 | McShane | |
| 5,975,323 | A | 11/1999 | Turan | |
| 6,364,511 | B1 | 4/2002 | Cohen | |
| 6,953,894 | B2 | 10/2005 | Ungerman et al. | |
| 7,449,633 | B2 | 11/2008 | Lalancette et al. | |
| 8,661,666 | B2 | 3/2014 | Grady | |
| 9,787,073 | B1 | 10/2017 | Townsend | |
| 10,027,099 | B1 | 7/2018 | Garvin | |
| 10,297,996 | B1 | 5/2019 | Smith et al. | |
| 10,400,964 | B2 | 9/2019 | Driscoll | |
| 10,408,396 | B2 | 9/2019 | Wronski et al. | |
| 10,443,822 | B2 | 10/2019 | Behnke et al. | |
| 2008/0180961 | A1* | 7/2008 | Gibson et al. | F21V 15/01 362/364 |
| 2011/0013405 | A1* | 1/2011 | Buse | F21V 21/34 362/365 |
| 2012/0186871 | A1 | 7/2012 | Roberts | |
| 2020/0032988 | A1* | 1/2020 | Schubert | F21V 21/04 |

OTHER PUBLICATIONS

Arlington DHB1C-1 Low Profile In Box Electrical Box with Adapter Sleeve for New Brick Construction. Amazon. Retreived from https://www.amazon.com/Arlington-DHB1C-1-Electrical-Construction-Horizontal/dp/B004K1G126, dated Nov. 4, 2020. 8 pages.

Electrical Box Extenders. Crescent Electric Supply Company. Retrieved from https://www.cesco.com/Electrical-Box-Extenders/c4407, dated Nov. 4, 2020. 6 pages.

* cited by examiner

*Primary Examiner* — Laura K Tso
(74) *Attorney, Agent, or Firm* — Gray Ice Higdon

(57) ABSTRACT

A recessed luminaire housing assembly for positionally sealing a fixed position junction box per code requirements is disclosed. The luminaire housing may include a fixed position junction box, a junction box interface hardware, and a vertically adjustable recessed light mounting housing. The recessed light mounting housing is adjustably and removably fastened to the junction box interface hardware and the fixed position junction box.

20 Claims, 5 Drawing Sheets

RECESSED LUMINAIRE HOUSING ASSEMBLY

BACKGROUND

This invention relates generally to the field of luminaires and more particularly is directed to a recessed luminaire housing assembly that facilitates installation in limited spaces with the fixed existing junction box embedded within concrete.

Surface mounted or recessed luminaires, such as flat LED downlights intended for ceiling or wall mount applications, are popular nowadays and often installed as new installations or as retrofits of existing luminaires. As such products always engage with existing junction boxes embedded within concrete, the limited spaces, which are often impractical to expand, and other building structural constraints may create difficulties for installations. For example, in many instances where the junction box is encased within concrete in the ceiling or the floor above, there is often a very limited height between the concrete and the junction box because of the dated constructions and the existing poured concrete. Thus, mounting recessed luminaires is often problematic due to the lack of the depth/volume required for accommodating all the necessary components of the recessed luminaires, such as electronic components, light emitters, lens, etc, while also ensuring adequate sealing of the junction box while providing the vertical adjustment of the recessed light.

Therefore, there remains a need in the art to improve the recessed luminaire installations with existing junction boxes, especially when the installation spaces are limited.

SUMMARY

The present disclosure sets forth a recessed luminaire housing assembly fully utilizing the interior space of the existing fixed junction box embedded within concrete for feasible installations, while complying with electrical enclosure code requirements over the variations of spaces that may be created under various architectural constructions. A portion or the entirety of the disclosed recessed luminaire housing assembly may extend into the existing junction box, with the volume thereof receiving the recessed luminaire. For example, an LED based recessed light fixture may be inserted into the disclosed recessed luminaire housing assembly after the housing assembly is affixed to an existing (concrete encased) junction box to positionally seal the junction box per code requirements.

Accordingly, the disclosed recessed luminaire housing assembly provides additional mounting volume for receiving the recessed luminaire as well as associated components such as controllers and other electronics, while limiting the protrusion of the recessed luminaire into the living space. Compared with existing recessed luminaire designs, the disclosed recessed luminaire housing assembly provides a solution for installing recessed lighting fixtures to almost any fixed junction boxes regardless of how the junction boxes are secured. The articulated design may be widely used for both new installations and existing building renovations.

In some embodiments, a luminaire housing may include a fixed position junction box, a junction box interface hardware, and a vertically adjustable recessed light mounting housing. The junction box may have a predefined geometric configuration, an interior volume, and a lower edge facing into a room interior. The junction box interface hardware may substantially match the predefined geometric configuration and the lower edge of the fixed position junction box, and be removably retained on the fixed position junction box lower edge. The recessed light mounting housing may have an upper electronic housing compartment and a lower light receiving compartment. The vertically adjustable recessed light mounting housing may be removably and adjustably fastened to the junction box interface hardware and the fixed position junction box to positionally seal the interior volume of the junction box with the upper electronic housing compartment of the recessed light mounting housing being in various positions relative to the fixed position junction box. The upper electronic housing compartment of the recessed light mounting housing may have at least one electronic component for a recessed luminaire, and the lower light receiving compartment of the recessed light mounting housing may have at least one light emitter for the recessed luminaire.

In some embodiments, the electronic component and the light emitter may form a recessed light housing, and the recessed light housing may be removably and retainably mounted within the recessed light mounting housing. In such embodiments, the recessed light housing may include a plurality of securing members for mounting within the recessed light mounting housing, and the plurality of securing members may include springs. In some embodiments, the electronic component may be electrically connected to a power supply within the fixed position junction box via at least one wire through the upper electronic housing compartment of the recessed light mounting housing and the junction box interface hardware, and the upper electronic housing compartment of the recessed light mounting housing may have a smaller geometry than that of the lower light receiving compartment of the recessed light mounting housing. In such embodiments, a portion of the lower light receiving compartment of the recessed light mounting housing surrounding the upper electronic housing compartment of the recessed light mounting housing may form an interfacing ledge with a second predefined geometric configuration, mating against or spacing apart from the junction box interface hardware, and the interfacing ledge may include one or more fasteners extending therethrough into the junction box interface hardware and the fixed position junction box. In some embodiments, the second predefined geometric configuration of the interfacing ledge may be different from the predefined geometric configuration of the fixed position junction box. For example, in such embodiments, the second predefined geometric configuration of the interfacing ledge/flange may be circular, and the predefined geometric configuration of the fixed position junction box may be hexagon.

In some embodiments, the junction box interface hardware may include a vertical extender, and the vertical extender may include a vertical sidewall configured to be slidably adjustable. In such embodiments, the vertical extender may mate the predefined geometric configuration of the fixed position junction box. In some other embodiments, the recessed light mounting housing may include an extension sleeve configured to be slidably adjustable. In some embodiments, the lower light receiving compartment of the recessed light housing may receive a lighting lens/diffuser of the recessed luminaire, and the lighting lens/diffuser of the recessed luminaire may be in flush with, recessed, and/or extends from a wall surface and/or ceiling. In some embodiments, the recessed light mounting housing may extend into the interior volume of the fixed position junction box. In such embodiments, the recessed light mounting housing may be entirely enclosed within the interior volume of the fixed position junction box.

In some embodiments, a luminaire housing may include a fixed position junction box, a junction box interface hardware, and a vertically adjustable recessed light mounting housing. The junction box may have a predefined geometric configuration, an interior volume, and a lower edge facing into a room interior, and the junction box interface hardware may be removably retained on the fixed position junction box lower edge. The vertically adjustable recessed light mounting housing may be removably and adjustably fastened to the junction box interface hardware and the fixed position junction box to positionally seal the interior volume of the fixed position junction box. The vertically adjustable recessed light mounting housing may receive at least one electronic component and at least one light emitter for a recessed luminaire.

In some further embodiments, a luminaire housing coupled to a fixed position junction box may include a junction box interface hardware and a vertically adjustable recessed light mounting housing. The junction box interface hardware may be removably retained on the fixed position junction box lower edge. The vertically adjustable recessed light mounting housing may have an upper electronic housing compartment and a lower light receiving compartment. The vertically adjustable recessed light mounting housing may be removably and adjustably fastened to the junction box interface hardware and the fixed position junction box to positionally seal the fixed position junction box with the upper electronic housing compartment of the recessed light mounting housing being in various positions relative to the fixed position junction box. The upper electronic housing compartment of the recessed light mounting housing may have at least one electronic component for a recessed luminaire, and the lower light receiving compartment of the recessed light mounting housing may have at least one light emitter for the recessed luminaire.

In an additional implementation, the present disclosure sets forth a luminaire housing which includes a junction box having an interior volume and a lower edge facing into a room interior, wherein the junction box is fixed in position within concrete or a hardened material. The combination further includes junction box interface hardware affixed to the junction box lower edge, the junction box interface configured to height adjustably receive an upper electronic housing compartment of a recessed light housing. The recessed light housing is vertically adjustable within the junction box through the junction box interface hardware, the recessed light housing removably fastened to the junction box interface hardware and to the junction box by the junction box interface hardware. The combination of the recessed light housing upper electronic housing compartment positionally seals the interior volume of the junction box by a geometric configuration of an opening of the junction box interface hardware substantially matching the received upper electronic housing compartment. Further, the recessed light mounting housing has at least one electronic component and at least one light emitter retained within the upper electronic housing compartment of the recessed light housing.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above-outlined features are to be understood as exemplary only, and many more features and objectives of the various embodiments may be gleaned from the disclosure herein. Therefore, no limiting interpretation of this summary is to be understood without further review of the entire specification, claims, and drawings included herewith. A more extensive presentation of features, details, utilities, and advantages of the present disclosure is provided in the following written description of various embodiments of the disclosure, illustrated in the accompanying drawings, and defined in the appended claims.

The above description is provided as an overview of some implementations of the present disclosure. Further description of those implementations, and other implementations, are described in more detail below.

It should be appreciated that all combinations of the foregoing concepts and additional concepts described in greater detail herein are contemplated as being part of the subject matter disclosed herein. For example, all combinations of claimed subject matter appearing at the end of this disclosure are contemplated as being part of the subject matter disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosure

DETAILED DESCRIPTION

In the following detailed description, for purposes of explanation and not limitation, representative embodiments disclosing specific details are set forth in order to provide a thorough understanding of the description. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatus and methods may be omitted so as to not obscure the description of the representative embodiments. For example, aspects of the apparatus disclosed herein are illustrated in conjunction with a lighting fixture (e.g., a flat LED downlight) including a particular generally cylindrical housing assembly. However, one or more aspects of the apparatus described herein may optionally be implemented in other housing configurations such as, for example, housings having a differing number of interior surfaces, housings having one or more non-planar surfaces, housings having an alternative light output opening, and/or housings having a different overall shape. Implementation of one or more aspects of the lighting fixture described herein with alternatively configured housings is contemplated herein. Embodiments may further be understood with reference to FIG. 4, which illustrates a typical ceiling application including poured concrete 1 covered by a ceiling panel 2. It should be understood that this is merely an exemplary arrangement and any of a variety of ceiling or other building structures (e.g., side walls, floors, etc.) may be the structural support in which the disclosed apparatus is installed.

Figure 1:
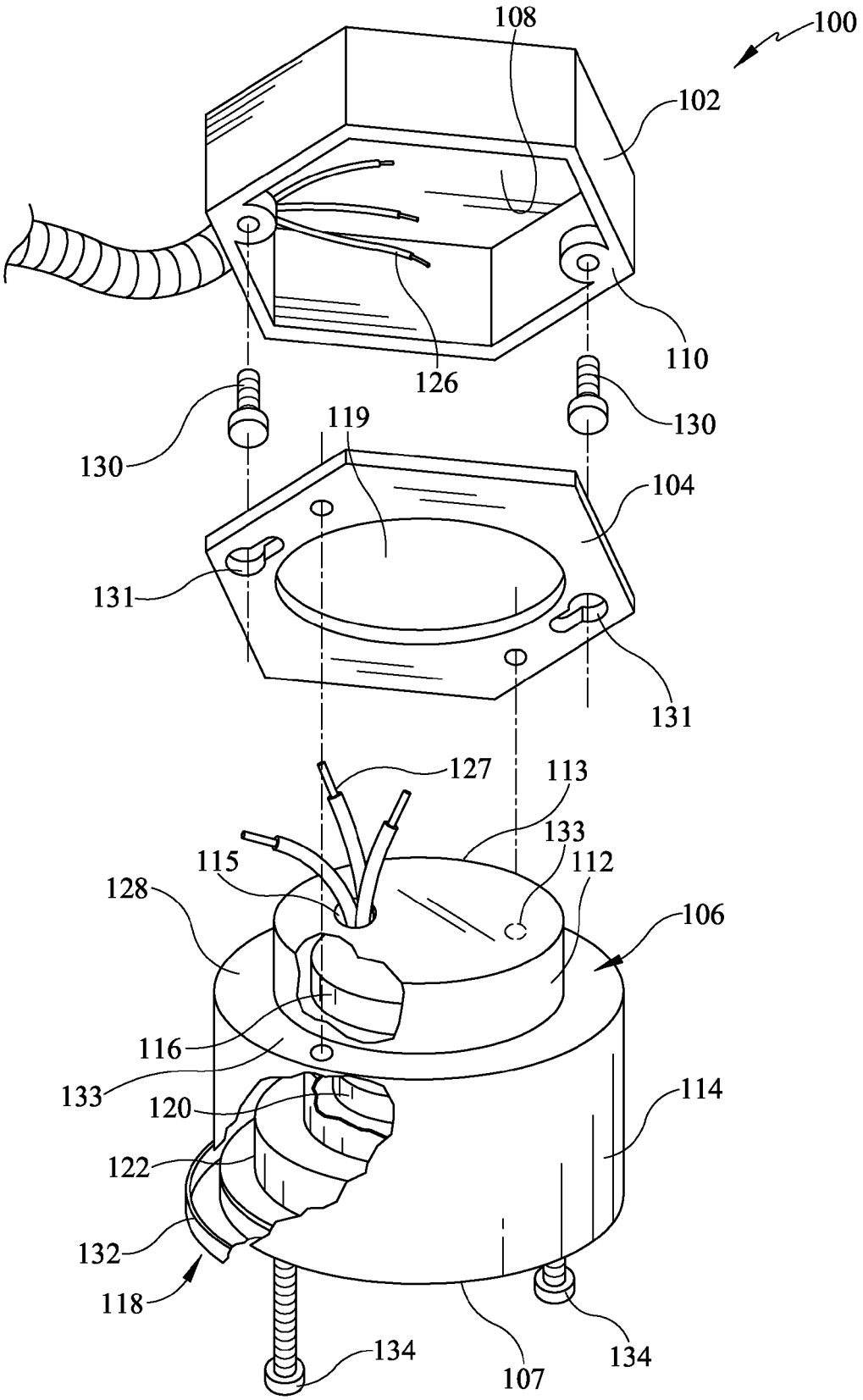
FIG. 1 is a perspective view of a recessed luminaire housing assembly, according to an embodiment of the present disclosure.
Figure 3:
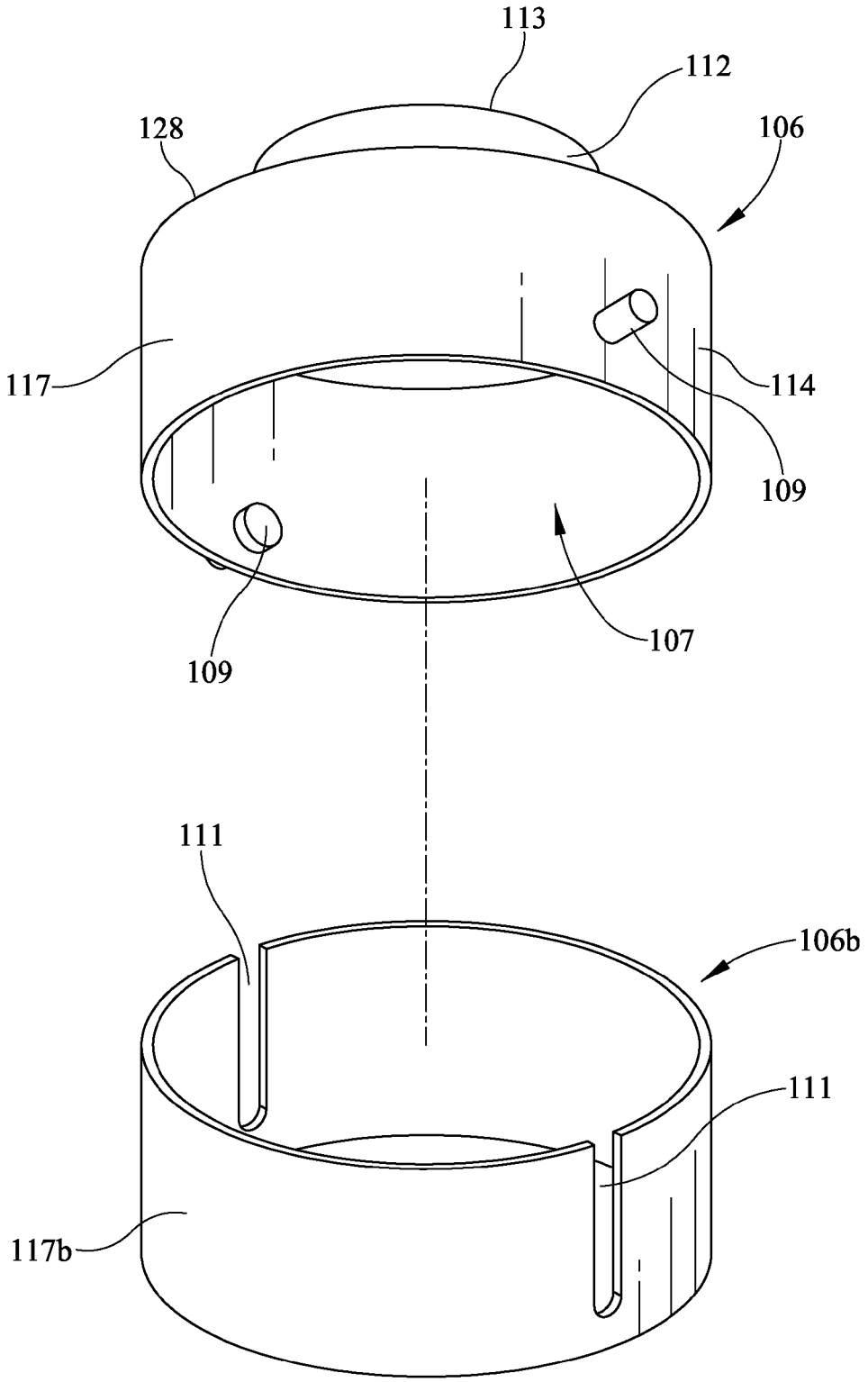
FIG. 3 is a partial and enlarged perspective view of a sliding extension sleeve option for the recessed luminaire housing assembly of FIG. 1, according to an embodiment of the present disclosure.
Figure 4:
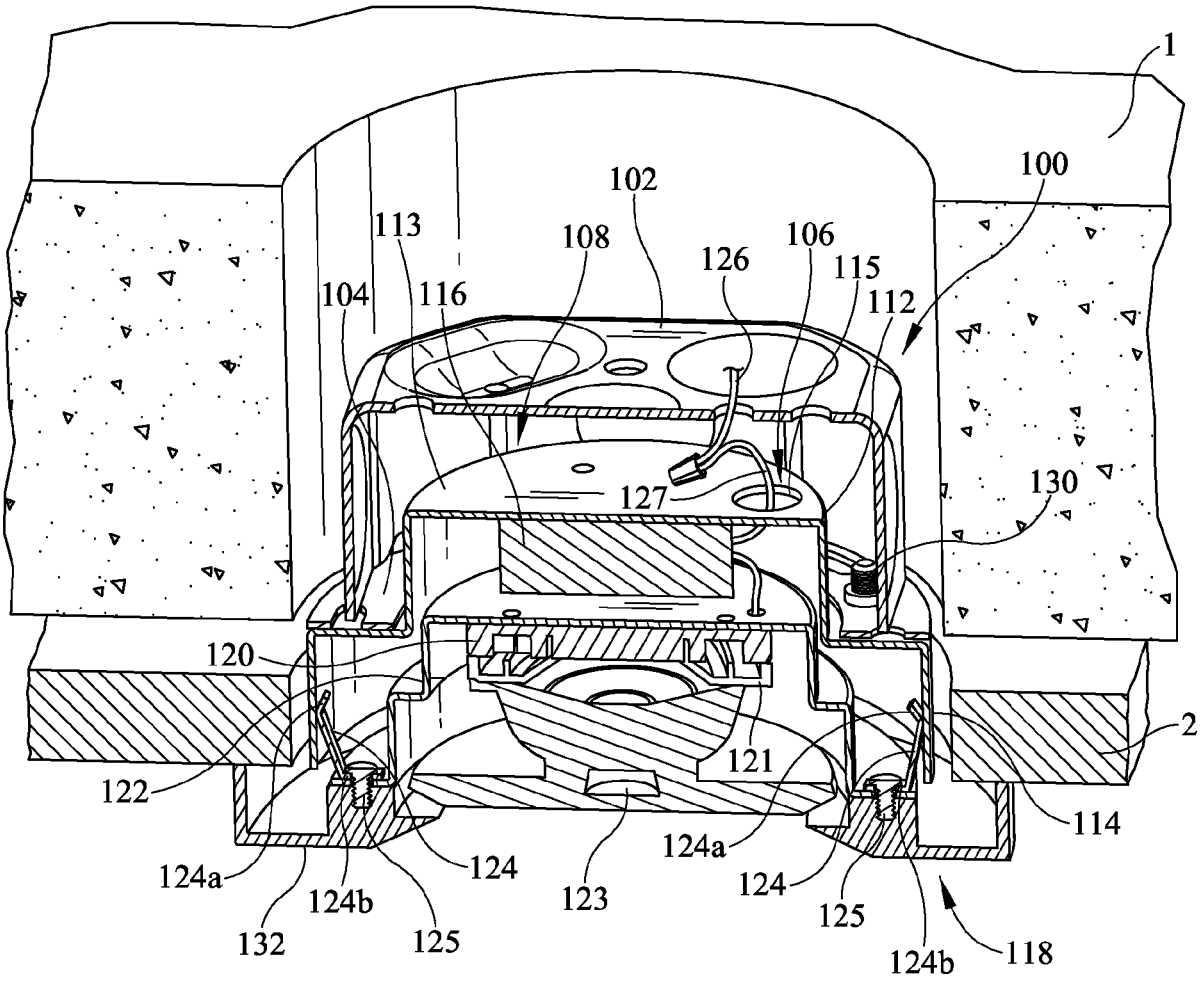
FIG. 4 is a cross-sectional view of a recessed luminaire housing assembly installed to an existing junction box located within a concrete ceiling space, according to an embodiment of the present disclosure.
Figure 5:
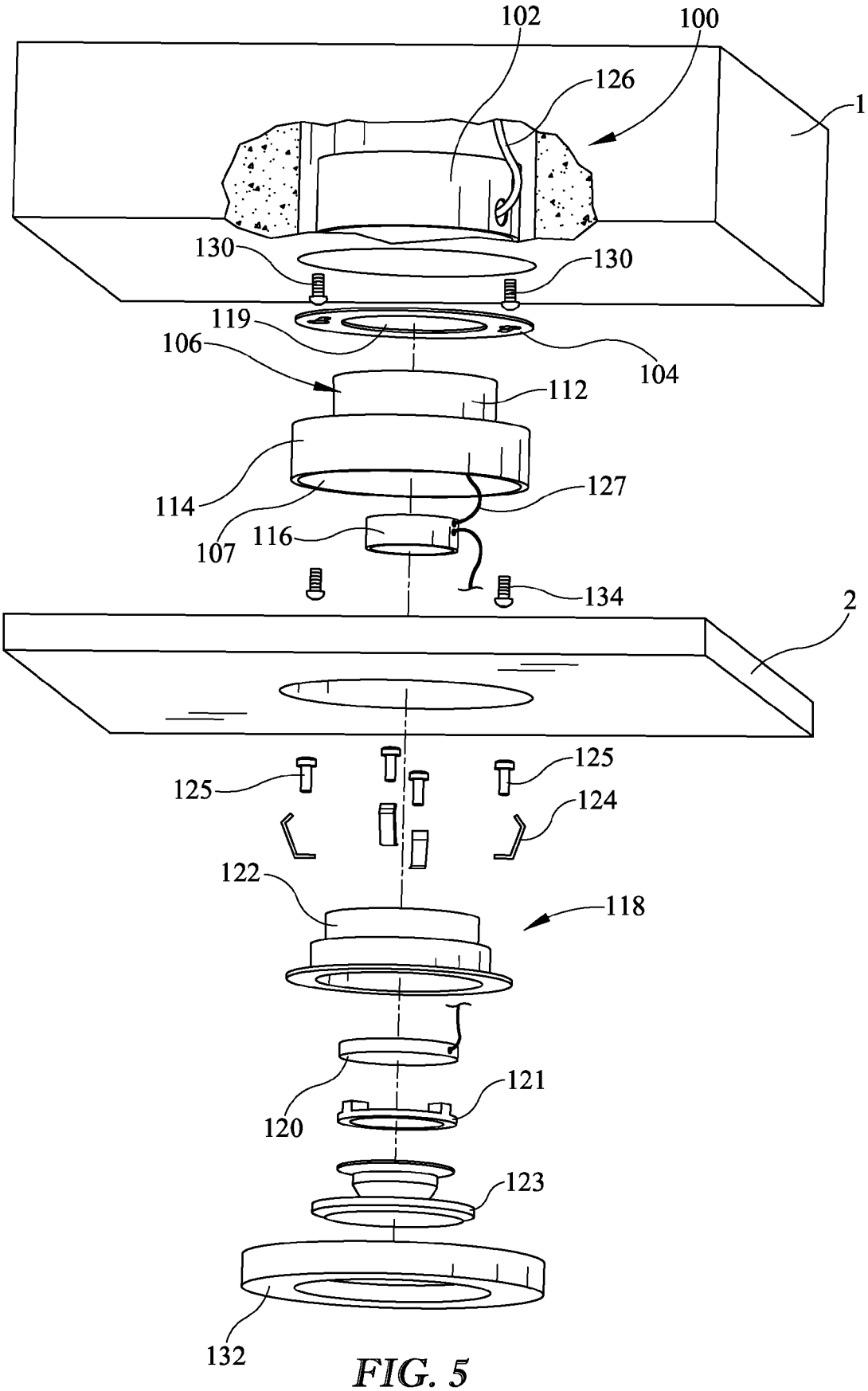
FIG. 5 is an exploded, perspective view of a recessed luminaire housing assembly installed to an existing junction box located within a concrete ceiling space, according to an embodiment of the present disclosure.

As depicted in the drawings, wherein like numbers denote like parts throughout the several views, a recessed luminaire housing assembly 100 in accordance with various embodiments will be described with reference to the accompanying drawings. In some embodiments as shown in FIG. 1, the recessed luminaire housing assembly 100 may include a fixed position junction box 102, a junction box interface hardware 104, and a vertically adjustable recessed light mounting housing 106. The junction box 102 may have a predefined geometric configuration (e.g., hexagon as shown in FIGS. 1-4, and circular as shown in FIG. 5), an interior volume 108 (e.g., a splice compartment), and a lower edge 110 facing into a room interior. It should be understood that this is merely an example, and the junction box 102 may take any of a variety of shapes, including, but not limited to, square, rectangular, polygonal, prismatic, round, cylindrical, spherical or any other shape or combination thereof. In various embodiments, the junction box 102 may be different substantially box shaped structures formed by various members and plates, thereby defining the interior volume 108 for housing components such as a power supply 126 and the recessed light mounting housing 106 as will be described in detail below. In some embodiments, the recessed light mounting housing 106 may be entirely enclosed within the interior volume 108 of the fixed position junction box 102.

Figure 2:
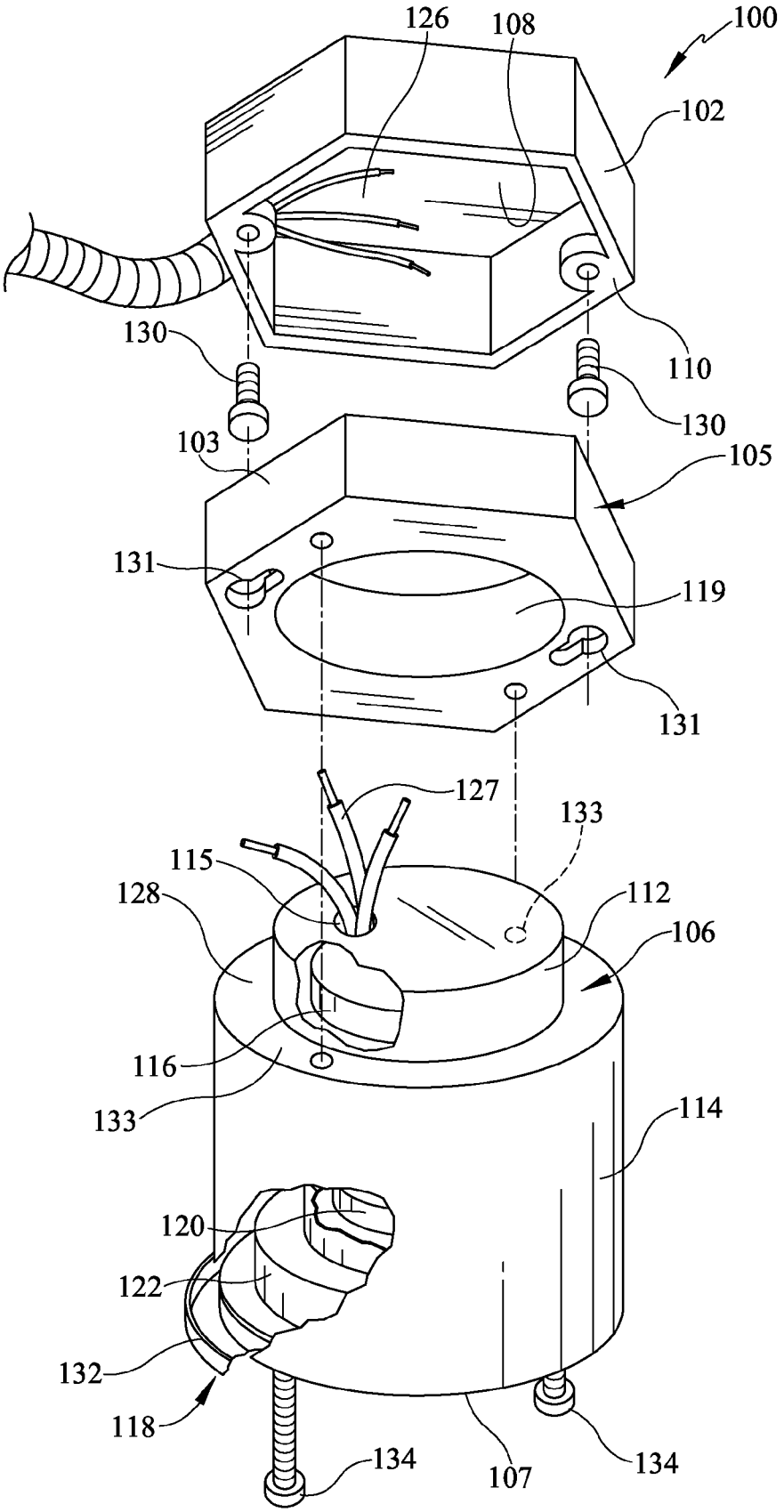
FIG. 2 is a perspective view of the recessed luminaire housing assembly of FIG. 1 with an extender option, according to an embodiment of the present disclosure.

In some embodiments, the junction box interface hardware 104 may be positioned adjacent to the lower edge 110 of the junction box 102 and/or be interposed between the junction box 102 and the recessed light mounting housing 106. In some embodiments, the junction box interface hardware 104 may be in a configuration substantially matching the predefined geometric configuration and/or the lower edge 110 of the junction box 102 and removably retained on the lower edge 110 of the fixed position junction box 102. For example, as shown in FIGS. 1 and 2, the junction box interface hardware 104 may be generally in a hexagon ring configuration having an hollow portion 119, with an outer perimeter dimension that is no larger than the lower edge 110 of the junction box 102. In some other embodiments as shown in FIG. 5, the junction box interface hardware 104 may be generally in a circular ring configuration to match with the circular configured junction box 102. In this way, the junction box interface hardware 104 may be attached, removed, and/or reattached to the junction box 102 through one or more fastening elements 130 as shown. However, it should be understood that, in some embodiments, the junction box interface hardware 104 may have a dimension larger than the lower edge 110 of the junction box 102 and/or be sized and/or configured independently of the lower edge 110 of the junction box 102. It should be understood that by substantially matching the predefined geometric configuration it is meant that the configuration of the junction box interface hardware 104 does not need to exactly match such configuration of the junction box 102 and/or the lower edge 110 thereof, but the configuration of the junction box interface hardware 104 may be sized to fit within the geometric opening formed by the junction box 102.

In some embodiments, the recessed light mounting housing 106 may have an upper electronic housing compartment 112 and a lower light receiving compartment 114 for accommodating a recessed luminaire 118. In some embodiments, the upper electronic housing compartment 112 may substantially match the predefined geometric configuration of the fixed position junction box 102 and extend into the interior volume 108 thereof. In some embodiments, the upper electronic housing compartment 112 of the recessed light mounting housing 106 may receive an electronic component 116 (e.g., one or more lighting drivers or controllers), that may operate and/or control the recessed luminaire 118, and the lower light receiving compartment 114 of the recessed light mounting housing 106 may receive a light emitter 120 (e.g., a LED board as shown) as the light source of the recessed luminaire 118. In such embodiments, the recessed light mounting housing 106 may include a light output opening 107 to allow light generated by the light emitter 120 to be outwardly cast therefrom. In such embodiments, the light output opening 107 may be sized and configured to allow insertion of the recessed luminaire 118 to pass therethrough. Similarly, the internal cavity of the recessed light mounting housing 106 may be sized to allow the recessed luminaire 118 to be installed therein. It should be understood that depth/volume of the recessed light mounting housing 106 may vary in different embodiments. For example, the recessed light mounting housing as shown in FIG. 2 may have a deeper/larger volume compared with the recessed light mounting housing 106 as shown in FIG. 1. It should be also understood that the front, rear, side, and/or top walls of the recessed light mounting housing 106 may contain apertures, slots, holes, or the like for any of a variety of reasons including, but not limited to, allowing ventilation and/or heat dissipation of the recessed luminaire 118 and/or allowing the one or more fasteners (e.g. screws 134) to go through for fixation.

In some embodiments, the upper electronic housing compartment 112 of the recessed light mounting housing 106 may have a smaller geometry than that of the lower light receiving compartment 114 of the recessed light mounting housing 106, and the smaller upper electronic housing compartment 112 may be accommodated/surrounded by the hollow portion 119 of the junction box interface hardware 104. In such embodiments, a portion of the lower light receiving compartment 114 of the recessed light mounting housing 106 surrounding the upper electronic housing compartment 112 of the recessed light mounting housing 106 may form an interfacing ledge 128 with a second predefined geometric configuration, mating against the junction box interface hardware 104. In such embodiments, the interfacing ledge 128 may include one or more openings 133 for the one or more fasteners 134 extending therethrough into the junction box interface hardware 104 and the fixed position junction box 102. In some embodiments, the second predefined geometric configuration of the interfacing ledge 128 may be different from the predefined geometric configuration of the fixed position junction box 102. For example, in some embodiments as shown in FIGS. 1 and 2, the interfacing ledge 128 may have a circular geometric configuration, while mating against or being spaced from the junction box interface hardware 104 and the junction box 102 that both have a hexagon geometric configuration.

It should be understood that in some embodiments, the upper electronic housing compartment 112 and/or the lower light receiving compartment 114 may be omitted from the recessed light mounting housing 106. For example, in some embodiments, the recessed light mounting housing 106 may be substantially longitudinally extending cylinder configuration with the same geometry throughout. It should be understood that the recessed light mounting housing 106 may take any of a variety of shapes, including, but not limited to rectangular, conical, cylindrical, round, spherical, or any other feasible shapes. It should be also understood that the recessed light mounting housing 106 may be in various positions relative to the junction box 102 to positionally seal the interior volume 108 of the junction box 102 per code requirements by adjusting the screw 134 in different positions. For example, in some embodiments, the upper electronic housing compartment 112 of the recessed light mounting housing 106 may be fully extended into the interior volume 108 of the junction box 102 to seal by tightening the screw 134. In some other embodiments, the upper/top surface of the recessed light mounting housing 106 may be in flush with the opening of the junction box 102 for sealing the interior volume 108 thereof per code requirements with the screw 134 in a relative loosened position.

In some embodiments, the recessed luminaire housing assembly 100 may also include features to increase the depth/volume thereof. For example, when the ceiling thickness is more than the typical depth of the disclosed recessed luminaire housing assembly 100, a vertical extender and/or a slidably extendable sleeve may be provided to further increase the depth/volume of the recessed luminaire housing assembly 100. For example, in some embodiments as shown in FIG. 2, the junction box interface hardware 104 interposed between the existing junction box 102 and recessed light mounting housing 106 may be a vertical extender 105, including a vertical sidewall 103 configured to be slidably adjustable. In some other embodiments as shown in FIG. 3, the recessed light mounting housing 106 may be configured to receive an extending sleeve **106*b* as an extender. In such embodiments, the recessed light mounting housing 106 may include a surrounding wall 117 interconnected between a top wall 113 and/or the interfacing ledge 128, and the light output opening 107, and the extending sleeve 106*b* in a tubular configuration may include an extending perimeter wall 117*b*. In different embodiments, the extending sleeve 106*b* may have a larger and/or smaller geometry than that of the recessed light mounting housing 106. In some embodiments, the surrounding wall 117 of the recessed light mounting housing 106 may have one or more lateral outward protrusions or pins 109, which may mate with one or more corresponding slots 111 located on the extending perimeter wall 117*b* of the extending sleeve 106*b*. This pin-slot mechanism may be configured to facilitate and guide the vertical sliding motion of the extending sleeve 106*b* within and/or surrounding the light mounting housing 106. In some embodiments, the pin 109 may be an adjustable screw configured to move the extending sleeve 106*b* in small increments. In such embodiments, the sliding mechanism advantageously allows fast adjustment of the extending sleeve 106*b* for a desired light mounting housing volume. In some embodiments, the recessed light mounting housing 106 and the extending sleeve 106*b* both have a circular-shaped configuration. It is contemplated, however, that the recessed light mounting housing 106 and the extending sleeve 106*b*** may be formed in a variety of complementary shapes including, but not limited to, circular, oval, square, rectangular, or octagonal, etc.

In some embodiments, for the recessed luminaire 118, the electronic component 116 and the light emitter 120 and any additional necessary luminaire components may be accommodated within a recessed light housing 122, and the recessed light housing 122 may be removably and retainably mounted within the recessed light mounting housing 106. In such embodiments, the recessed light housing 122 may include a plurality of securing members (e.g., springs, screws. etc.) for mounting within the recessed light mounting housing 106. For example, the recessed light housing 122 of the recessed luminaire 118 may be removably attached, installed, and/or connected to the recessed light mounting housing 106 by use of a plurality of spring or compressible clips 124, with a first end **124*a* thereof extending toward the interior surface of the recessed light mounting housing 106, and a second end 124*b* thereof attaching to the recessed light housing 122 via one or more fasteners, such as screws 125 as shown in FIGS. 4 and 5. In such embodiments, the recessed light housing clip 124 may be cantilevered or otherwise made to be compressible and/or spring at an end near the light output opening 107 of the recessed light mounting housing 106 as shown in FIG. 3. In some embodiments, the interior surface of the recessed light mounting housing 106 may contain one or more notches (not visible in the figures), and the first end 124*a* of the recessed light housing clip 124 may include outwardly extending protrusions. Thus, squeezing or compressing the recessed light housing clip 124 may allow insertion of the recessed light housing 122 of the recessed luminaire 118 within the recessed light mounting housing 106, then releasing or seizing the compression may allow the plurality of luminaire housing clips 124 to spring outwardly thus allowing protrusions to engage notches, thereby securing the recessed light housing 122 in position within the recessed light mounting housing 106. Further, this configuration may allow removability and/or separation of the recessed light housing 122 from the recessed light mounting housing 106 by compressing the plurality of luminaire housing clips 124. It should be understood that the second end 124*b* of the recessed light housing clip 124 may be attached to the recessed light housing 122** via various manners, for example, via various adhesives, such as RTV silicones and double-sided tapes.

In different embodiments, the light emitter 120 for the recessed luminaire 118 may be configured to have any of a number of optical or other features. Further, the light emitter 120 may be removably or separably replaced and installed within the recessed light housing 122 as discussed herein. Thus, the recessed luminaire 118 may provide modularity by allowing removal of one type of light emitter 120 and installation of another type of the light emitter 120 that, for example, may output any of a variety of different colors or spectra or other output. Examples of light outputs that may be provided by the light emitter 120 include, but are not limited to, direct down lighting, wall washing, spotlighting, and/or any of a variety of outputs. Further examples include varying translucency, output light color or spectrum, and/or varying color temperature to have a warmer or cooler feel by replacing the light emitter 120. In this way, optical output may be varied by replacing the light emitter 120 without the need to replace the entire recessed luminaire 118.

As is depicted in the embodiments of FIGS. 1-5, the recessed luminaire 118 may obtain power via the power supply 126 from the junction box 102. For example, the electronic component 116 and the light emitter 120 may be electrically connected to the power supply 126 within the fixed position junction box 102 via at least one wire or electrical connector 127 through the upper electronic housing compartment 112 (or directly through the recessed light mounting housing 106) and the hollow portion 119 of the junction box interface hardware 104. For example, in some embodiments as shown in FIGS. 1 and 2, the top wall 113 of the upper electronic housing compartment 112 may include a wire opening 115 that is sized and configured to allow the electrical connector 127 to pass substantially therethrough to connect within the junction box 102 and/or to allow the power supply 126 to pass therethrough to connect within the recessed light mounting housing 106. It should be understood that the location/quantity/configuration of the wire opening 115 is not limited here.

In some embodiments, as shown in FIG. 4, the electrical connectors 126 and 127 may be quick connectors configured with twist cap connected to the double insulated multi-conductor cable, oftentimes referred to as Romex wires (the 110V AC hot, neutral, and ground wires) from the junction box 102. In such embodiments, the power wires 126 and 127 may be reusable quick connect electrical connectors to allow the recessed luminaire 118 to be connected to the junction box 102 without the requirement of the complicated wiring procedure and one or more tools needed for connecting the power supply 126 from the junction box 102 to the electrical connector 127 of the recessed luminaire 118, thus saving the time, effort, and cost of installers. It should be understood that other versions/types of reusable quick connect electrical connectors may also be used here, such as rotational type electrical connectors.

It should be understood that this is merely one way to transmit power to the recessed luminaire 118, and that any of a variety of power transmittal mechanisms may be used, such as wireless power transmittal mechanisms. In some embodiments, the electronic component 116 may include the internal power modification functions as needed, such as AC to DC converters, capacitors, and any other voltage and current modification techniques that may be utilized. For example, the electronic component 116 may accept standard 120 V AC line voltage provided by the junction box 102 and modify. Such modifications may include AC to DC conversion, PWM drivers, smoothing or chopping circuits and the like as are well-known in the art to provide adequate power to the luminaire. The converted electricity can then be provided to the associated components, such as the light emitter 120.

To aid in attachment and/or removal of the junction box interface hardware 104 and the recessed light mounting housing 106 to the junction box 102, in some embodiments, the recessed light mounting housing 106 may be removably fastened to the junction box interface hardware 104 and the fixed position junction box 102 via one or more fastening elements 134 (e.g., screws) through one more first fastening openings 131 located on the junction box interface hardware 104 and/or the one or more second fastening openings 133 located on the recessed light mounting housing 106 (e.g., on the top wall 113 and/or on the interfacing ledge 128 thereof). The screw 134 may provide a convenient way to remove and/or attach the junction box interface hardware 104 and the recessed light mounting housing 106 by hand, although it should be understood that the screws 130 and 134 are merely one example of the affixation mechanism that may be used. Other examples may include, but are not limited to, wingnuts, clips, snaps, buttons, bolts, nuts, and/or any other feasible affixation mechanisms. Limited embodiments are shown here for the mechanical and electrical connections between the junction box 102 and the luminaire 118, but it should be understood that a variety of mechanical and electrical connectors and methods may be used to fasten the recessed light mounting housing 106 to the junction box 102 mechanically and connect the power supply 126 from the junction box 102 to the recessed luminaire 118.

It should be understood that the recessed luminaire 118 may include any additional components besides the electronic component 116, the light emitter 120 and the recessed light housing 122. For example, in some embodiments, a lighting lens/diffuser 123 may be provided to facilitate transmittal of light from the light emitter 120 outwardly through the light output opening 107. In such embodiments, a light emitter support 121 may be provided between the light emitter 120 and the lens 123. The lens 123 may optionally be included for any of a variety of reasons, including, but not limited to, providing and/or enhancing light output, protecting any or all components of the recessed luminaire 118, and/or providing a safety measure to prevent, for example, electric shock or electrocution by contact with electricity. If included, lens 123 may substantially cover the light output opening 107 and/or may be substantially translucent, transparent, and/or a diffusing lens.

As shown in FIGS. 4 and 5, in some embodiments, the lighting lens/diffuser 123 of the recessed luminaire 118 may be in flush, recessed and/or extends from with the ceiling 2 and be oriented downwardly to allow light to be cast downwardly, such as, for example, used as overhead or ceiling lighting. It should be understood that the disclosed luminaire housing assembly 100 is not limited to ceiling mount orientations, and may be used in any of a variety of orientations, including, but not limited to, wall mount and/or floor mount orientations. Thus, in some embodiments, the luminaire housing assembly 100 may cast light upwardly, downwardly, horizontally, and/or at any angle relative thereto. In some embodiments, the lens 123 may be substantially planar as shown, although it should be understood that lens 123 may be any of a variety of shapes including, but not limited to, prismatic and/or having a depth extending inwardly or outwardly from the recessed light mounting housing 106, rounded, spherical, and/or any other shape. In some embodiments, a lighting flange or plate 132 may be provided for purposes such as merely decorations or any other desired purposes such as further facilitating transmittal of light from the light emitter 120 outwardly through the light output opening 107 and the lens 123. It is further understood that lens 123 and/or the lighting flange 132 may be colored, textured, and/or include features to, for example, provide a desired optical effect. It should be understood that, although the lens 123 and the lighting flange 132 are illustrated as substantially co-extensive and/or co-planar, it should be understood that they are not so limited. Any the lens 123 and the lighting flange 132 may be offset in any direction relative to one another, may be smaller or larger than any other, may be transverse to one another, and/or may be sized and/or configured without any substantial relationship to any other. In other words, these Figures are merely exemplary and are not to be construed as limiting, as lens 123, and/or the lighting flange 132 may be designed and/or formed independently of one another.

In some embodiments, any or all of the components of the recessed luminaire housing assembly 100, such as the junction box 102, the junction box interface hardware 104, and the recessed light mounting housing 106 may be substantially formed of sheet metal. It should be understood, however, that any of a variety of materials may be used, including, but not limited to, plastic, rubber, wood, composites, and/or any of a variety of materials or a combination thereof. It should be also understood that the different components of the recessed luminaire housing assembly 100 may be in a variety of constructions, shapes, sizes, quantities, and positions but still accomplish the same intent, without departing present disclosure As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semiconductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light emitter" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light emitter may be configured to generate electromagnetic radiation within the visible spectrum, outside the visible spectrum, or a combination of both. Hence, the terms "light" and "radiation" are used interchangeably herein. Additionally, a light emitter may include as an integral component one or more filters (e.g., color filters), lenses, or other optical components. Also, it should be understood that light emitters may be configured for a variety of applications, including, but not limited to, indication, display, and/or illumination. An "illumination source" is a light emitter that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light emitter in all directions, in terms of radiant power or "luminous flux") to provide ambient illumination (i.e., light that may be perceived indirectly and that may be, for example, reflected off of one or more of a variety of intervening surfaces before being perceived in whole or in part).

For purposes of this disclosure, the term "color" is used interchangeably with the term "spectrum." However, the term "color" generally is used to refer primarily to a property of radiation that is perceivable by an observer (although this usage is not intended to limit the scope of this term). Accordingly, the terms "different colors" implicitly refer to multiple spectra having different wavelength components and/or bandwidths. It also should be appreciated that the term "color" may be used in connection with both white and non-white light. Lower color temperatures generally indicate white light having a more significant red component or a "warmer feel," while higher color temperatures generally indicate white light having a more significant blue component or a "cooler feel." By way of example, fire has a color temperature of approximately 1,800° K, a conventional incandescent bulb has a color temperature of approximately 2848° K, early morning daylight has a color temperature of approximately 3,000° K, and overcast midday skies have a color temperature of approximately 10,000° K. A color image viewed under white light having a color temperature of approximately 3,000 degree K has a relatively reddish tone, whereas the same color image viewed under white light having a color temperature of approximately 10,000° K has a relatively bluish tone.

The term "color temperature" generally is used herein in connection with white light, although this usage is not intended to limit the scope of this term. Color temperature essentially refers to a particular color content or shade (e.g., reddish, bluish) of white light. The color temperature of a given radiation sample conventionally is characterized according to the temperature in degrees Kelvin (K) of a black body radiator that radiates essentially the same spectrum as the radiation sample in question. Black body radiator color temperatures generally fall within a range of from approximately 700° K (typically considered the first visible to the human eye) to over 10,000° K; white light generally is perceived at color temperatures above 1500-2000° K.

While several inventive embodiments have been described and illustrated herein, those of ordinary skill in the art will readily envision a variety of other means and/ or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope.

What is claimed:

1. A luminaire housing, comprising:

a fixed position junction box having a predefined geometric configuration, an interior volume, and a lower edge facing into a room interior;

a junction box interface hardware substantially matching the predefined geometric configuration and the lower edge of the fixed position junction box, and removably retained on the fixed position junction box lower edge; and a vertically adjustable recessed light mounting housing having an upper electronic housing compartment and a lower light receiving compartment, wherein the vertically adjustable recessed light mounting housing adjustably and removably fastened to the junction box interface hardware and the fixed position junction box, the upper electronic housing compartment of the recessed light mounting housing having at least one electronic component for a recessed luminaire, and the lower light receiving compartment of the recessed light mounting housing having at least one light emitter for the recessed luminaire.

2. The luminaire housing of claim 1, wherein the at least one electronic component and the light emitter retained by a recessed light housing, and the recessed light housing is removably and retainably mounted within the recessed light mounting housing.

3. The luminaire housing of claim 2, wherein the recessed light housing includes a plurality of securing members for mounting within the recessed light mounting housing.

4. The luminaire housing of claim 3, wherein the plurality of securing members include springs.

5. The luminaire housing of claim 1, wherein the at least one electronic component is electrically connected to a power supply within the fixed position junction box via at least one wire through the upper electronic housing compartment of the recessed light mounting housing and the junction box interface hardware.

6. The luminaire housing of claim 1, wherein the upper electronic housing compartment of the recessed light mounting housing has a smaller geometry than that of the lower light receiving compartment of the recessed light mounting housing.

7. The luminaire housing of claim 6, wherein a portion of the lower light receiving compartment of the recessed light mounting housing surrounding the upper electronic housing compartment of the recessed light mounting housing forms an interfacing ledge with a second predefined geometric configuration, mating against, or being spaced from the junction box interface hardware.

8. The luminaire housing of claim 7, wherein the interfacing ledge includes one or more fasteners extending therethrough into the junction box interface hardware and the fixed position junction box.

9. The luminaire housing of claim 7, wherein the second predefined geometric configuration of the interfacing ledge is different from the predefined geometric configuration of the fixed position junction box.

10. The luminaire housing of claim 9, wherein the second predefined geometric configuration of the interfacing ledge is circular, and the predefined geometric configuration of the fixed position junction box is hexagon.

11. The luminaire housing of claim 1, wherein the junction box interface hardware includes a vertical extender.

12. The luminaire housing of claim 11, wherein the vertical extender includes a vertical sidewall configured to be slidably adjustable.

13. The luminaire housing of claim 11, wherein the vertical extender mates the predefined geometric configuration of the fixed position junction box.

14. The luminaire housing of claim 1, wherein the recessed light mounting housing includes an extension sleeve configured to be slidably adjustable.

15. The luminaire housing of claim 1, wherein the lower light receiving compartment of the recessed light mounting housing receives a lighting lens/diffuser of the recessed luminaire.

16. The luminaire housing of claim 15, wherein the lighting lens/diffuser of the recessed luminaire is at least one of flush with, and recessed and extends from one of a wall surface or ceiling.

17. The luminaire housing of claim 1, wherein the recessed light mounting housing extends into the interior volume of the fixed position junction box.

18. A luminaire housing, comprising:

a fixed position junction box having a predefined geometric configuration, an interior volume, and a lower edge facing into a room interior;

a junction box interface hardware removably retained on the fixed position junction box lower edge; and a vertically adjustable recessed light mounting housing adjustably and removably fastened to the junction box interface hardware and the fixed position junction box to positionally seal the interior volume of the fixed position junction box, wherein the vertically adjustable recessed light mounting housing receives at least one electronic component and at least one light emitter for a recessed luminaire.

19. A luminaire housing, comprising:

a junction box interface hardware removably retained on a fixed position junction box; and a vertically adjustable recessed light mounting housing having an upper electronic housing compartment and a lower light receiving compartment, the upper electronic housing compartment positionally sealing an interior volume of the fixed position junction box, wherein the recessed light mounting housing is adjustably and removably fastened to the junction box interface hardware and the fixed position junction box, the upper electronic housing compartment of the recessed light mounting housing receives at least one electronic component for a recessed luminaire, and the lower light receiving compartment of the recessed light mounting housing receives at least one light emitter for the recessed luminaire.

20. A luminaire housing, comprising:

a junction box having an interior volume and a lower edge facing into a room interior, wherein the junction box is fixed in position within concrete or a hardened material;

junction box interface hardware affixed to the junction box lower edge, the junction box interface configured to height adjustably receive an upper electronic housing compartment of a recessed light housing;

the recessed light housing vertically adjustable within the junction box and through the junction box interface hardware, the recessed light housing removably fastened to the junction box interface hardware and to the junction box by the junction box interface hardware;

wherein the combination of the recessed light housing upper electronic housing compartment positionally sealing the interior volume of the junction box by a geometric configuration of an opening of the junction box interface hardware substantially matching the received upper electronic housing compartment;

wherein the recessed light mounting housing has at least one electronic component and at least one light emitter retained within the upper electronic housing compartment of the recessed light housing.

* * * * *